US011313117B2

(12) United States Patent
Nieves

(10) Patent No.: US 11,313,117 B2
(45) **Date of Patent: *Apr. 26, 2022**

(54) METHOD FOR RAISING A FRAMED STRUCTURE

(71) Applicant: Raul S. Nieves, Houston, TX (US)

(72) Inventor: Raul S. Nieves, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/901,719

(22) Filed: Jun. 15, 2020

(65) Prior Publication Data

US 2020/0308823 A1 Oct. 1, 2020

Related U.S. Application Data

(63) Continuation-in-part of application No. 15/916,172, filed on Mar. 8, 2018, now Pat. No. 10,683,659.

(51) Int. Cl.
*E04B 1/35* (2006.01)
*E04G 23/06* (2006.01)
(Continued)

(52) U.S. Cl.
CPC ..... *E04B 1/3527* (2013.01); *E04B 2/707* (2013.01); *E04G 23/06* (2013.01); *E04G 23/065* (2013.01); *E04B 5/12* (2013.01)

(58) Field of Classification Search
CPC .... E04B 1/3527; E04B 1/3522; E04B 1/3511; E04B 2/707; E04G 23/065; E04G 23/06; E04G 23/0266; E02D 35/00
See application file for complete search history.

(56) References Cited

U.S. PATENT DOCUMENTS 570,370 A * 10/1896 Breuchaud ..... E02D 35/00 405/230
1,789,070 A * 1/1931 Gross ..... E04B 1/34 52/236.4
(Continued)

FOREIGN PATENT DOCUMENTS

EP 1760201 A1 ‡ 3/2007 ..... E04G 23/06
FR 2978174 A1 * 1/2013
(Continued)

OTHER PUBLICATIONS

Federal Emergency Management Agency 'FEMA'; Homeowner's Guide to Retrofitting; Six Ways to Protect You Home From Flooding; FEMA p. 312, 3rd Edition; Jun. 2014.‡
(Continued)

*Primary Examiner* — Brian D Mattei
*Assistant Examiner* — Charissa Ahmad
(74) *Attorney, Agent, or Firm* — Rao DeBoer Osterrieder, PLLC; Dileep P. Rao

(57) ABSTRACT

A method of raising a framed structure. The method comprises the steps of: supporting a roof structure of the framed structure, cutting a stud of the framed structure at a desired level, leaving a bottom portion of the stud in place, removing a top portion of the stud, raising the roof structure of the framed structure, installing a flooring structure on the bottom portion of the stud, building a wall structure using a second stud supported by and secured to the flooring structure, lowering the roof structure onto the wall structure, and securing the roof structure to the wall structure. The method also allows for the leveling of the framed structure without modifications to the foundation. The method further allows for newly raised structures to have higher ceilings and modified floor plans without changes to the foundation.

8 Claims, 2 Drawing Sheets

(51) Int. Cl.
*E04B 2/70* (2006.01)
*E04B 5/12* (2006.01)

(56) References Cited

U.S. PATENT DOCUMENTS 2,389,573 A * 11/1945 Balduf ..... E04B 1/30 52/234
2,722,040 A ‡ 11/1955 Ludowici ..... E04B 1/0007 254/92
2,846,731 A * 8/1958 Abler ..... E04B 1/3404 52/169.9
3,796,055 A ‡ 3/1974 Mahony ..... E02D 27/48 254/29 R
4,058,952 A * 11/1977 Donnelly ..... E04B 1/34357 52/745.02
4,563,851 A * 1/1986 Long ..... E04C 2/386 52/656.1
5,775,847 A ‡ 7/1998 Carlinsky ..... E02D 27/32 405/229
5,937,607 A * 8/1999 Li ..... E04C 2/384 52/656.1
6,240,695 B1 * 6/2001 Karalic ..... E04C 3/02 52/656.1
6,379,085 B1 ‡ 4/2002 Vanderklaauw ..... B66F 1/00 405/230
6,427,407 B1 * 8/2002 Wilson ..... E04B 1/08 52/481.1
6,923,599 B2 ‡ 8/2005 Kelso ..... E02D 27/48 187/203
7,665,251 B1 * 2/2010 Lang ..... E04B 1/24 52/91.3
8,926,227 B2 ‡ 1/2015 Zago ..... E02D 35/00 405/230
9,238,920 B1 ‡ 1/2016 Carlinsky ..... E04H 9/145
2002/0124487 A1 ‡ 9/2002 Dimitrijevic ..... E02D 35/00 52/126.1
2009/0142140 A1 ‡ 6/2009 Collina ..... B66F 7/20 405/230
2009/0188177 A1 ‡ 7/2009 Wensel ..... E04G 21/163 52/122.1
2014/0190120 A1 ‡ 7/2014 Warren ..... E04F 13/007 52/747.1
2014/0290154 A1 ‡ 10/2014 Perko ..... E04H 9/145 52/126.5
2014/0346421 A1 ‡ 11/2014 Wensel ..... E04G 23/065 254/89 R
2015/0121778 A1 ‡ 5/2015 Rawding ..... E04H 9/145 52/169.9
2015/0204091 A1 ‡ 7/2015 Long ..... E04G 23/065 52/741.1
2016/0010349 A1 ‡ 1/2016 Jenner ..... E04G 23/065 52/126.1

FOREIGN PATENT DOCUMENTS

GB 2055130 A ‡ 2/1981 ..... E02D 35/00
GB 2055130 A 2/1981

OTHER PUBLICATIONS

Above the Flood: Elevating Your Floodprone House, published by FEMA on May 2000 (FEMA Publication No. 347) (Year: 2000).‡

* cited by examiner
‡ imported from a related application

METHOD FOR RAISING A FRAMED STRUCTURE

CROSS REFERENCE TO RELATED APPLICATIONS

The present application is a Continuation in Part of U.S. patent application Ser. No. 15/916,172 filed on Mar. 8, 2018, titled "METHOD FOR RAISING A FRAMED STRUCTURE," issued as U.S. Pat. No. 10,683,659 on Jun. 16, 2020. This reference is incorporated herein in its entirety.

FIELD

The present disclosure generally relates to a method for raising a framed structure.

BACKGROUND

Due to housing and commercial real estate development, structures such as houses, and commercial buildings often become subject to flooding after they are constructed. As urban development often changes drainage patterns in the area, houses or other buildings that were not originally thought to be at risk when built often find themselves in an area that is in danger of flooding.

One solution to this problem is to raise the living area to a desired flood protection elevation. Previous methods have been extremely costly and time consuming. Typical methods utilized have been to raise the entire slab foundation upon which a building is constructed, or to raise the constructed portion by building a crawlspace under it through the use of additional foundation or concrete walls.

Various drawbacks to the current state of the art limit their efficacy. Often, slabs that are being raised are not engineered for "floating" in air and can pose safety risks to the inhabitants of the structure. Further, for houses with attached garages, this method must overcome significant hurdles.

When building a crawlspace underneath the existing structure, a significant amount of weight is added which is required to be supported by the foundation, which was not engineered with this additional weight requirement in mind. This may result in costly changes to the foundation being required.

Further, when raising an already flood damaged structure, the living area still utilizes the structural components (such as studs in framing structures) which have been exposed to a flood and may have been damaged by flooding or have issues with bacteria and mold collection.

Current methods are extremely costly and time consuming to implement. Further, there is little to no flexibility for the owner to remodel or replace structural materials without considerable added expense.

A need exists, therefore, for a method of raising a structure which is cost efficient, addresses the capabilities of the existing foundation, and allows flexibility to change the interior of the structure.

The present disclosure meets the above needs.

BRIEF DESCRIPTION OF THE DRAWINGS

The detailed description will be better understood in conjunction with the accompanying drawings as follows.

Figure 1A:
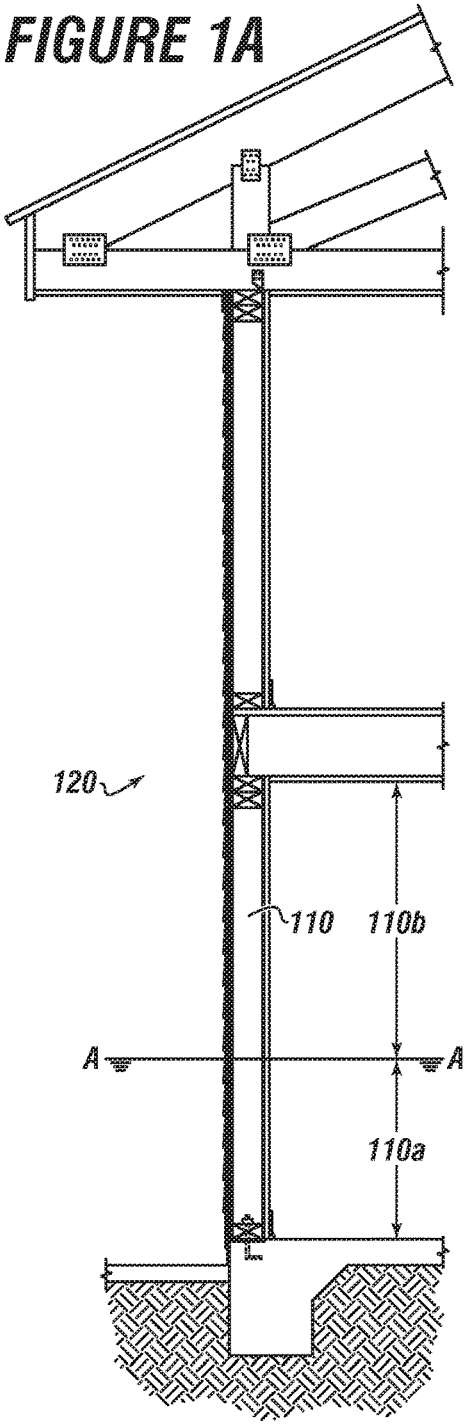
FIGS. 1A, 1B, 1C and 1D depict cut views of a two-story home according to one or more embodiments of use of the present method.

The embodiments of the present disclosure are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a method for raising a framed structure.

The present method is superior to existing methods in several aspects. The presently disclosed method adds minimal weight to a structure when raising it. The presently disclosed method allows for recycling of building materials, while still resulting in a cleaner and healthier occupied area. The presently disclosed method allows for the leveling of structures during raising. Finally, in the event of a flood event, the present method will result in a structure which displaces less volume of fluid than other previous methods and/or construction for raising a structure.

It should be noted that some steps can be performed in a different order than as embodied or described herein without exceeding the scope of the present disclosure.

The method of raising a framed structure can comprise the steps of: supporting a roof structure of the framed structure, cutting a stud of the framed structure at a desired level, leaving a bottom portion of the stud in place, removing a top portion of the stud, raising the roof structure of the framed structure, installing a flooring structure on the bottom portion of the stud, building a wall structure using a second stud supported by and secured to the flooring structure, lowering the roof structure onto the wall structure, and securing the roof structure to the wall structure.

Examples to enable the present disclosure shall utilize a residential house with a wooden frame. However, similar techniques can be used on other structures with alternate framing materials.

The method encompasses raising a framed structure. It will often be desirable to raise a framed structure, or the inhabitable area of the framed structure above a certain height, such as a flood protection elevation.

A framed structure can be any building or structure comprising a frame secured to a foundation with a roofing structure attached to the frame. A typical frame can have vertical support members referred to as studs. Most residential buildings in the United States are constructed in this manner, using wood as the framing material.

The method can comprise the step of supporting a roof structure of the framed structure. Typical methods include using jacks, cranes, or other supports to hold up the roof structure. Often wooden or concrete blocks are stacked below beams supporting the roof structure. Roof structure as used herein refers to the covering of at least the inhabitable portions framed area, including structures such as upper stories, attics, joists, ceiling tiles, and the like.

Upon supporting the roof structure, the studs of the framed structure can be cut at a desired height or elevation. In instances that the foundation has settled unevenly, the studs can be cut at different lengths (as measured from the foundation) in order to level the structure. The bottom portion of the stud, typically secured to a foundation in some manner is left in place.

The top portion of the studs of the framed structure can be removed, leaving the roof structure "floating" on the supports used. The top portion of the stud, along with any other material can be recycled or re-used for other purposes during construction. For example, some or all of the top portion of the stud can be used to reinforce the bottom portion of the stud.

The bottom portion of the stud can now serve as a crawlspace for the structure, thereby raising the inhabitable portion of the structure by a desired height. A new flooring structure can be built and secured to the bottom portion of the stud. A new wall structure can be built using a second stud and secured to the flooring structure. The roof structure can then be lowered onto the wall structure and secured thereto.

In embodiments, the bottom portion and the top portion can also be referred to as the lower portion and the upper portion of the stud. In embodiments, the wall structure can also be referred to as a support structure.

Exterior sheathing, such as brick, stucco, or siding can be applied for cosmetic purposes and protection against the elements. In embodiments, heavy sheathing, such as brick, can be replaced with stucco or siding to minimize impact on the foundation.

Example Embodiment

A fifty-year-old, single story brick house is flooded as a result of a tropical storm. Approximately three feet of water enters the house. The homeowner wishes to continue living in the residence but wishes to raise the house by at least three feet to avoid a recurrence of flooding.

The previously existing methods include raising the slab foundation upon which the house sits. This is a difficult task, as the house has an attached garage built upon the same slab foundation. Furthermore, the slab is extremely old and would require significant re-engineering and reinforcement for this option.

Another previously existing method would be to raise the entire house and build a concrete wall for the desired height on the existing slab foundation. This method adds a considerable weight load to the existing slab foundation, also requiring significant re-engineering and reinforcement for this option.

Both options result in the homeowner being unable to renovate or remodel any of the interior of the home and flood damaged studs may still be present within the inhabitable area of the home. Further, both existing options are extremely expensive and take a considerable amount of time to complete.

Using the methods of the present disclosure, however a cost efficient and relatively rapid raising of the house can be accomplished.

First the roof structure of the house (including the attic and ceiling joists) are supported on a jack. The house has eight-foot-high walls and studs. Because of some uneven settling of the foundation, the East side of the house is slightly lower than the West side. Using a laser level, the studs of the house's frame are marked at a desired cut elevation (such as three feet above the floor level). Because of the process used, the flooring will no longer be tilted. The studs are cut at the marked points. The bottom portion of the studs are left in place, and the top portion of the studs are removed. The top portions of the studs can be disposed of, recycled, used to replace water damaged bottom portions of the studs, or reinforce the bottom portions of the studs.

The bottom portions of the stud now serve as the frame for a crawlspace beneath the house. Further, materials and structures exposed to flood waters have been removed from the inhabitable area of the house.

A new flooring structure can be built upon the bottom portions of the studs. At this time, the homeowner can choose to change the flooring to another material if desired. New walls can be framed for the house on the new flooring structure. Because of current construction trends, the homeowner can choose to frame ten-foot walls instead of eight-foot walls.

Without changing the location of load bearing walls, rooms can be resized, added, or eliminated in the floorplan of the house. During the framing of the walls, plumbing and electrical wiring can be replaced to meet new safety codes and standards.

These changes are easily accomplished by changing the size and location of the studs which are not structurally significant as determined by persons having ordinary skill in the art.

Floorplans can be drastically modified. Because of the newly created crawlspace beneath the structure, plumbing can be rerouted and even wet areas, such as kitchens and bathrooms, can be relocated as desired.

The ability to completely change the floorplan and living areas while raising a structure to be less likely to flood is a novel byproduct of this method which is not enabled by currently utilized methods in the art.

The roof can then be secured to the new wall structure. Many of the components of the previous structure, such as stud caps, fasteners, material, etc. can be re-used as appropriate.

The homeowner decides to replace the brick sheathing of the house with stucco. Due to the weight difference, this offsets the weight of the additional wood used in raising the house to require no engineering changes or reinforcement to the slab foundation.

Applying the method of the present disclosure, the homeowner has been able to level the flooring, raise the ceilings, make the house safer, and renovate the house interior and exterior while raising it above a desired elevation for a fraction of the cost of previous methods.

Turning now to the Figures, FIG. 1A depicts a cut view of a two-story home.

Figure 1B:
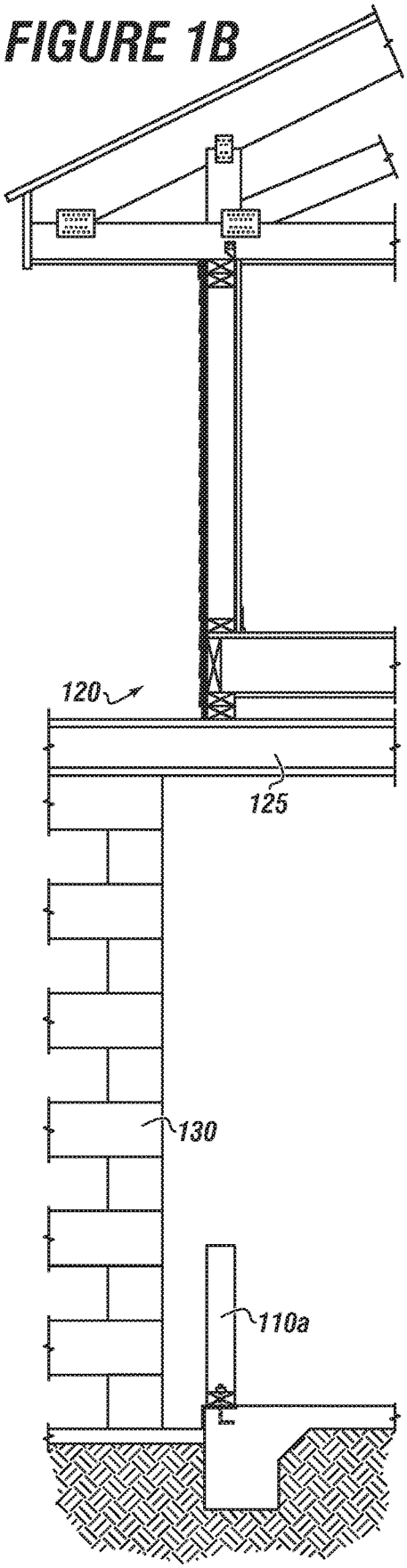

Line AA represents the desired flood protection elevation. Roof structure 120, which in this instance includes a second floor of the house, is shown here. Stud 110 with lower portion 110*a* and upper portion 110*b* are also shown FIG. 1B depicts a cut view of a two-story home.

Stud 110 can be cut at the desired flood protection elevation. Upper portion 110*b* (which is not shown) can be removed, leaving lower portion 110*a* secured to the foundation. Roof structure 120 can be elevated on support structure 130 with the use of beam 125. In embodiments, the support structure can be a wall structure.

Figure 1C:
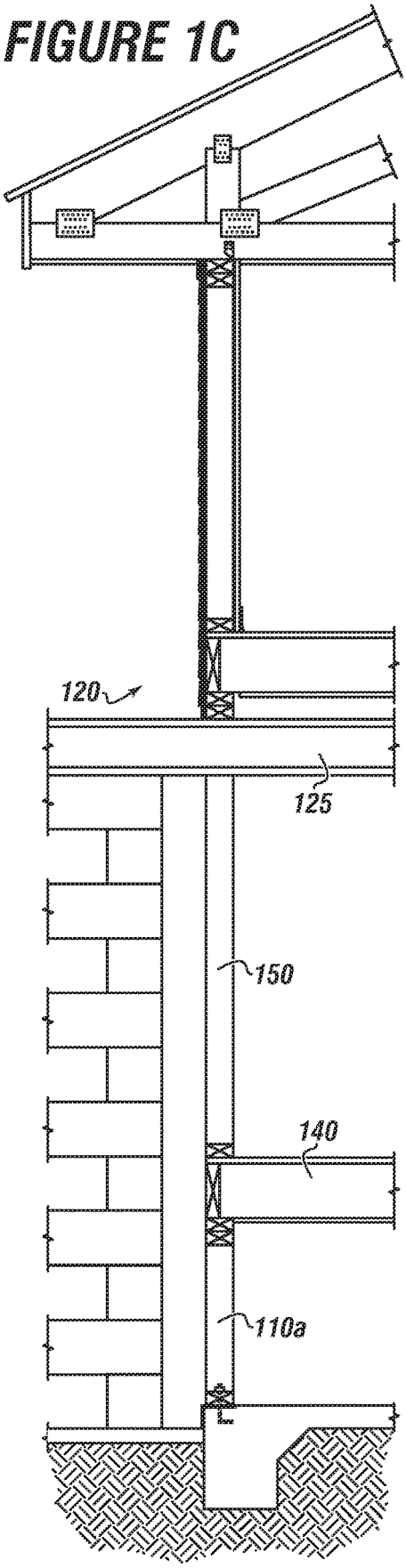

FIG. 1C depicts a cut view of a two-story home.

A flooring structure 140 can be installed and secured to lower portion 110*a*. Second stud 150 can be secured to the flooring structure after which the roof structure 120 can be secured to second stud 150.

Figure 1D:
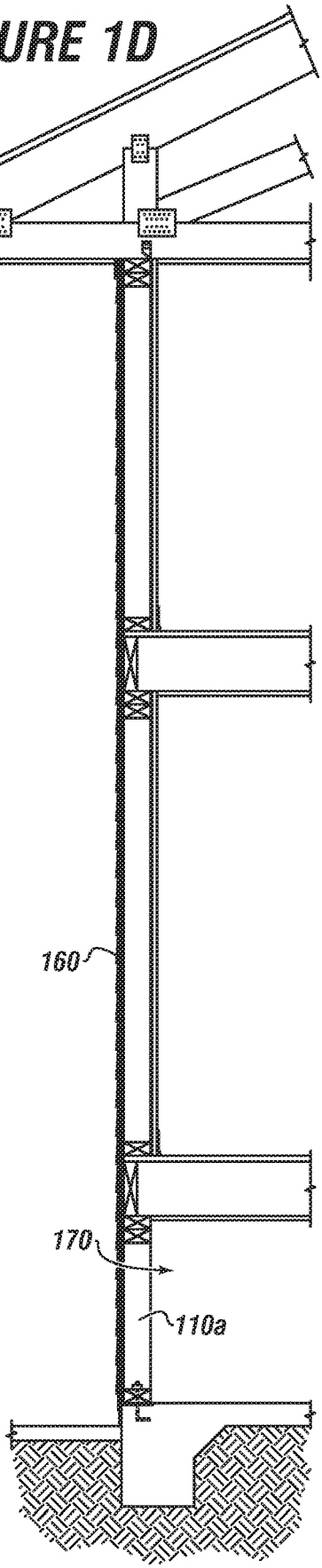

FIG. 1D depicts a cut view of a two-story home.

The exterior sheathing 160 of the house can be replaced as desired. Lower portion 110*a* defines the height of crawlspace 170 which has been created.

While the present disclosure emphasizes the embodiments, it should be understood that within the scope of the appended claims, the disclosure might be embodied other than as specifically described herein.

What is claimed is:

1. A method of raising a framed structure comprising the steps of:

a) supporting a roof structure of the framed structure;

b) cutting all studs of the framed structure at a desired level, creating a top portion of each stud and a bottom portion of each stud;

c) leaving the bottom portion of each stud in place;

d) removing the top portion of each stud;

e) raising the roof structure of the framed structure;

f) installing a flooring structure on a top of the bottom portion of each stud, such that the bottom portion of the stud is not included in a living area of the framed structure;

g) building a wall structure upon the flooring structure using a second stud supported by and secured to the flooring structure;

h) lowering the roof structure onto the wall structure; and i) securing the roof structure to the wall structure.

2. The method of claim 1, further comprising the step of using the top portion of each stud to reinforce the bottom portion of the first stud.

3. The method of claim 1, wherein the second stud is taller than each stud.

4. The method of claim 1, wherein the second stud is placed in a location other than directly above each stud.

5. A method of raising a framed structure comprising the steps of:

a) supporting a roof structure of the framed structure;

b) cutting all studs of the framed structure at a desired level, creating a top portion of each stud and a bottom portion of each stud;

c) leaving the bottom portion of each stud in place;

d) removing the top portion of each stud;

e) raising the roof structure of the framed structure;

f) installing a flooring structure on a top of the bottom portion of each stud, such that the bottom portion of the stud is not included in a living area of the framed structure;

g) building a wall structure upon the flooring structure using a plurality of new studs supported by and secured to the flooring structure;

h) lowering the roof structure onto the wall structure; and i) securing the roof structure to the wall structure.

6. The method of claim 5, wherein the framed structure is leveled when cutting the studs of the framed structure by cutting each stud at a different level as needed.

7. The method of claim 5, wherein each new stud is taller than each stud.

8. The method of claim 5, wherein at least one new stud of the plurality of new studs is placed in a different location than directly above each stud.

* * * * *